United States Patent [19]

Ament

[11] Patent Number: 4,584,983

[45] Date of Patent: Apr. 29, 1986

[54] ARCHERY BOW STABILIZER AND EMBEDDED ARROWHEAD REMOVER

[76] Inventor: Gary S. Ament, Star Rte. #1, Box #18, Alstead, N.H. 03602

[21] Appl. No.: 536,720

[22] Filed: Sep. 28, 1983

[51] Int. Cl.[4] ..... F41B 5/00

[52] U.S. Cl. ..... 124/89; 29/254; 273/416

[58] Field of Search ..... 124/89, 1, 86, 23 R, 124/24 R; 29/254, 275; 273/416, 419

[56] References Cited

U.S. PATENT DOCUMENTS

| | | | |
|---|---|---|---|
| 3,529,497 | 9/1970 | Brooks | 29/254 X |
| 3,890,692 | 6/1975 | Jandura | 273/416 X |
| 4,043,020 | 8/1977 | Hoggard | 273/416 X |
| 4,125,927 | 11/1978 | Geary | 29/254 |
| 4,150,469 | 4/1979 | Hoggard | 29/254 |
| 4,169,454 | 10/1979 | Jones | 124/89 |
| 4,387,697 | 6/1983 | Duke | 29/254 |

*Primary Examiner*—Richard J. Apley
*Assistant Examiner*—William R. Browne
*Attorney, Agent, or Firm*—Diller, Ramik & Wight

[57] ABSTRACT

An archery bow stabilizer and embedded arrowhead remover formed by a bolt having a head at one end and internal and external threads at an opposite end, two weights carried by the bolt, and a relatively thin disc being sandwiched between the weights, the latter structure being utilized as an archery bow stabilizer by threading the external thread to a stabilizer socket of a bow, and in order to remove an arrowhead embedded in a tree or the like, one of the weights is removed, the bolt is secured to a threaded stem of an arrowhead from which the arrow shaft has been removed, and the remaining weight on the bolt is manually reciprocated against the bolt head to create impact forces which are transferred through the bolt to the arrowhead to, thus, facilitate the removal thereof.

18 Claims, 5 Drawing Figures

ARCHERY BOW STABILIZER AND EMBEDDED ARROWHEAD REMOVER

As is ofttimes the case, when an archer or hunter misses an intended target the arrowhead can become embedded in a tree, the wooden frame of a target or the like from which removal is difficult, if not impossible, without bending or breaking the arrow or its components, such as the blades, shaft, or the like. Furthermore, many states have hunting regulations which prevent the use of a knife or like digging implement to gouge wood out of a tree in the area of an embedded arrowhead to remove the same. Obviously, arrowheads and/or arrows are expensive and it is highly desirable to remove embedded arrowheads for subsequent reuse and to do so without damage to the arrow. or the components thereof.

Heretofore, tools for removing embedded arrowheads have been provided as, for example, in U.S. Pat. Nos. 4,150,469 and 4,043,020, both in the name of Anthony J. Hoggard. The tool of the latter patents includes a shaft which projects through a hole and is secured by a threaded hole to the embedded arrowhead. Thereafter, a handle is simply reciprocated along the shaft and the arrowhead can be extracted. However, when not being used to extract arrowheads, the tool is simply packaged and presumably placed in the pocket of the archer/bowman/hunter. Thus, the tool is simply an arrowhead extracter or remover, but does not function as a bow stabilizer which is, of course, the second function of the combined archery bow stabilizer and arrowhead remover disclosed more specifically herein.

Another U.S. Pat. No. (4,169,454) in the name of Lonnie M. Jones discloses an extracter for arrowheads which also can be used as a stabilizer. The stabilizer is secured to a bow by one of its ends in a conventional manner and the stem has a head traversed by a bore of a greater diameter than the stabilizer stem. In order to extract an arrowhead, the stem of the stabilizer is removed from the bow, slid through the opening or bore and then is used as a lever after a threaded portion is connected to the embedded arrowhead. However, the lever action itself is undesired since the tendency thereof is to create forces which are not linear but are instead curved which tend to bend the arrowhead ferrule or shaft.

In keeping with the foregoing, a primary object of the present invention is to provide a novel combined archery bow stabilizer and embedded arrowhead remover which includes a bolt having opposite ends, one end of the bolt having a head and the opposite end of the bolt having internal and external threads, and a weight carried by the bolt, the weight serving as a stabilizer when one of the threads of the bolt is secured to the bow, and another of the threads being utilized to connect the bolt to the threaded shaft or ferrule of an embedded arrowhead so that the weight can then be manually impacted against the head of the bolt and the impact forces transferred through the bolt to the arrowhead to thus facilitate the removal thereof.

Still another object of this invention is to provide a combined archery bow stabilizer and arrowhead remover as aforesaid including means in the form of a disc of plastic or like material which is carried by the bolt such that the fingers of the user can be positioned between the disc and the weight when the latter is manually reciprocated along the bolt so that the disc prevents the user's fingers from being damaged by the rearwardly facing tips or points of an arrowhead.

Still another object of this invention is to provide a combined archery bow stabilizer and arrowhead remover of the type immediately described including a second weight carried by the bolt, the disc being sandwiched between the two weights, the two weights being utilized only when the overall combination is being used as a stabilizer for an associated bow, and one of the weights being removed and unused when the combination is used to create the aforesaid impact forces during arrowhead removal.

With the above and other objects in view that will hereinafter appear, the nature of the invention will be more clearly understood by reference to the following detailed description, the appended claims and the several views illustrated in the accompanying drawing.

IN THE DRAWING

Figure 1:
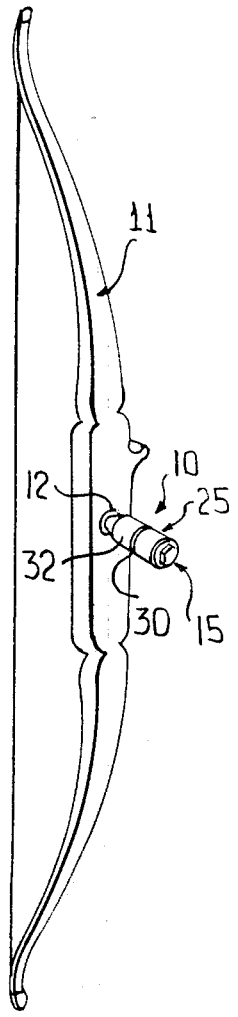
FIG. 1 is a perspective view of a bow constructed in accordance with this invention, and illustrates the combined archery bow stabilizer and embedded arrowhead remover when utilized as a bow stabilizer.
Figure 2:
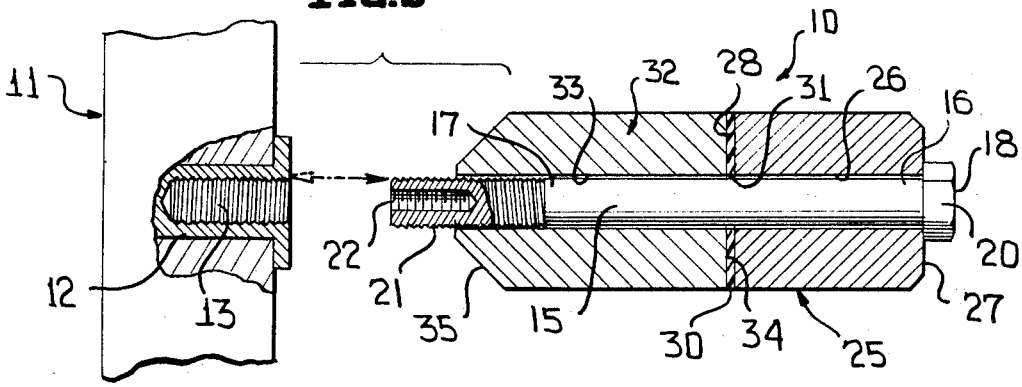
FIG. 2 is an enlarged axial sectional view taken through the combined archery bow stabilizer and arrowhead remover, and illustrates a disc sandwiched between two weights all of which are slidably mounted on a bolt having a head and inner and outer threads.

A novel combined archery bow stabilizer and embedded arrowhead remover is best illustrated in FIGS. 1 and 2 of the drawings and is generally designated by the reference numeral 10. The stabilizer/arrowhead remover 10 is illustrated in FIG. 1 threadably connected to a bow 11 in a manner which will be described more fully hereinafter, it being necessary only to note that the bow 11 includes a socket 12 (FIG. 2) having an internal thread 13.

Figure 4:
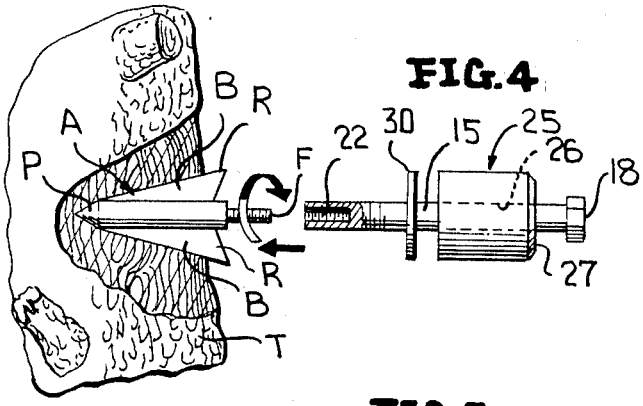
FIG. 4 is a fragmentary side elevational view, and illustrates the removal of one of the weights from the stabilizer/arrowhead remover prior to threading the bolt upon the threaded ferrule or shaft of the arrowhead.
Figure 5:
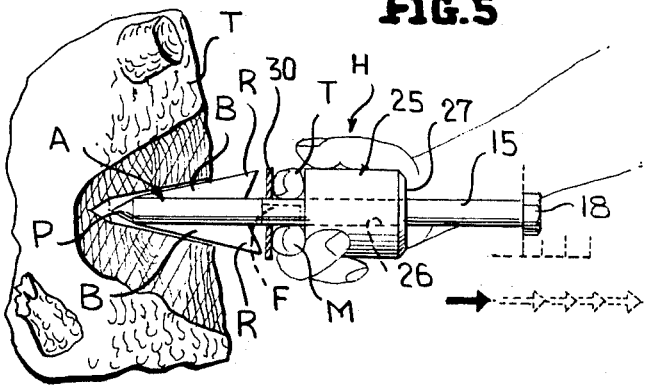
FIG. 5 is a side elevational view, and illustrates the manner in which the weight is manually driven toward the bolt head to create impact forces for removing the embedded arrowhead.

The stabilizer/arrowhead remover 10 includes a generally elongated shaft or bolt 15 having opposite end portions 16, 17, with one of the end portions 16 having an enlarged head 18 and a plurality of flat faces, each of which is generally designated by the reference numeral 20. The end portion 17 remote from the head 18 includes first means in the form of external threads 21 for securing the stabilizer 10 to the bow 11 by simply threading the threads 21 upon the threads 13 of the socket 12, as is most apparent from FIGS. 1 and 2 of the drawing. The end portion 17 further includes second securing means in the form of threads or an internally threaded bore 22 for securing the bolt 15 to a threaded stem, shaft or ferrule F of an arrowhead A which is embedded in a tree or tree trunk T after, of course, a shaft S has been removed from the ferrule F in a conventional manner shown in FIG. 3. The arrowhead A shown in FIGS. 3 through 5 is a conventional hunting arrowhead having a front tip or point P, a plurality of blades B and rear tips or points R.

Returning to FIG. 2 of the drawing, the stabilizer 10 further includes a first generally cylindrical weight or body 25 having a cylindrical bore 26 and opposite axial flat faces 27, 28. Immediately adjacent the first weight 25 is a disc 30 of relatively tough plastic or like material having a central opening 31. Immediately adjacent the disc 30 is another weight 32 having a bore 33, a flat radial face 34 and a frusto-conical face 35 most adjacent the end portion 17 of the bolt 15.

The stabilizer/arrowhead remover 10 is used as a bow stabilizer in the manner illustrated in FIGS. 1 and 2 of the drawing, namely, with the end portion 21 firmly threaded in the threaded bore 13 of the bow 11 and with both weights 25, 32 carried by the bolt 15 with the disc 30 sandwiched therebetween. The bolt 15 is tightened so that the weights 25, 32 are immobilized or, stated otherwise, are firmly clamped between the insert 12 and the head 18. In this fashion, the unit functions as a stabilizer during hunting and/or archery practice.

Figure 3:
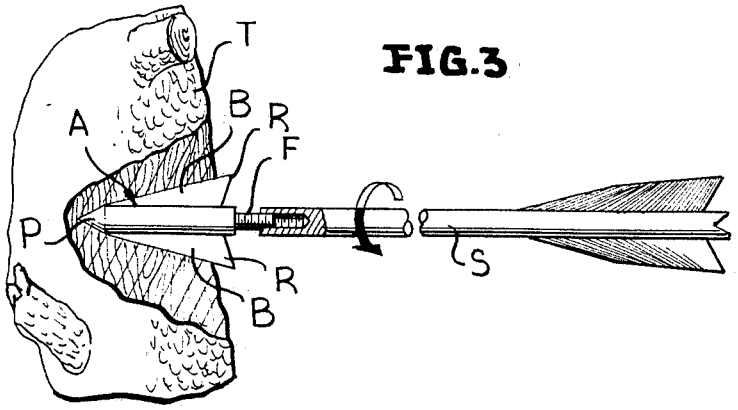
FIG. 3 is a fragmentary side elevational view of an arrowhead embedded in the tree trunk, and illustrates the manner in which a shaft of the arrow is removed incident to utilizing the stabilizer to remove the arrowhead.

During hunting and/or practice, should an arrow become embedded in a tree T in the manner earlier described relative to FIG. 3, the shaft S of the "standard" or conventional arrow is removed, thus exposing the threaded ferrule F. An appropriate tool can be applied to the head 18 of the bolt 15, and the latter rotated to remove the bolt 15 from the threads 13 of the socket 12. Thereafter, the weight 32 is removed from the bolt 15 and the threads 22 of the bolt 15 are threaded upon the threaded ferrule F, as initially indicated in FIG. 4 by an inward movement and then simply a rotation of the bolt 15.

After the bolt 15 has been thus secured to the threaded ferrule F of the embedded arrowhead A, the bolt 15 in the area of the end portion 17 is straddled by the index and middle fingers I, M, respectively, of a person's hand H (FIG. 5). The fingers I, M, are also sandwiched between the weight 25 and the disc 30. Thereafter, the person's hand H is forcefully moved toward and drives the face 27 of the weight 25 against the head 18 to impact the latter, thus creating an impact force which is transferred by the bolt 15 to the arrowhead through the connected threads 22, F. A single or several such impact forces can be created by simply reciprocating one's hand H toward and away from the head 18 until such time as the arrowhead A is driven from its imbedded position within the trunk T, as is illustrated in FIG. 5. It is to be particularly noted that during the movement of the hand H away from the head 18 and toward the arrowhead A, the fingers I, M could contact and, thus, be cut by the rear tips R of the arrowhead A. Thus, the disc 30 functions during such movement of the hand H toward the arrowhead A to protect the back of the user's fingers I, M against injury. Once the arrowhead A has been removed from the tree trunk T, the bolt 15 is simply unthreaded, the weight 32 is repositioned thereon, and the threads 21 are once against threaded upon the threads 13 returning the stabilizer/arrowhead remover to the in-use position relative to the bow 11, again as shown fully in FIG. 1 of the drawings. The invention thus described provides an excellent unit for infield/hunting use, simply because it is carried purely as a stabilizer on the bow 11 until such time as an arrowhead has to be removed. When this occurs, it is a relatively simply operation to "breakdown" the stabilizer by removing the same from the bow 11 in the manner heretofore described, simply removing the single weight 32 and then performing the connecting and impacting steps heretofore described. After being reassembled, the bow 11 again becomes essentially the "carrier" for the stabilizer/arrowhead remover or extracter. Therefore, a separate carrying case or the like is unnecessary and, just as important, the adaptability between the two functions of the stabilizer-/arrowhead remover is quick and efficient.

Although only a preferred embodiment of the invention has been specifically illustrated and described herein, it is to be understood that minor variations may be made in the apparatus without departing from the spirit and scope of the invention, as defined in the appended claims.

What is claimed is:

1. A combined archery bow stabilizer and embedded arrow head remover comprising a generally elongated shaft having opposite end portions, an enlarged head at one of said opposite and portions, a first weight means slidably movable along said shaft between said end portions when utilized as an arrow head remover and being immovable relative to said shaft when utilized as a bow stabilizer, first means on said shaft for securing the other of said opposite end portions to an archery bow, said first weight means function as a bow stabilizer, second means on said shaft for securing said other end portion to the stem of an arrow head embedded in a tree or the like, and the first weight means can be manually impacted against said enlarged head to create impact forces transferred through said shaft to an arrow head to thus facilitate the removal thereof from a tree or the like.

2. The combination as defined in claim 1 wherein said first securing means is a thread.

3. The combination as defined in claim 1 wherein said second securing means is a thread.

4. The combination as defined in claim 1 wherein said first securing means is an external thread.

5. The combination as defined in claim 1 wherein said second securing means is an internal thread.

6. The combination as defined in claim 1 wherein said first and second securing means are threads.

7. The combination as defined in claim 1 wherein said first and second securing means are respective external and internal threads.

8. The combination as defined in claim 7 including means for protecting the back of a users fingers against injury by tines of the arrow head during manual movement of the first weight means in a direction away from said enlarged head.

9. The combination as defined in claim 8 including means for protecting the back of a users fingers against injury by tines of the arrow head during manual movement of the first weight means in a direction away from said enlarged head, and said protecting means is a thin disc slidably carried by said shaft.

10. The combination as defined in claim 7 including means for protecting the back of a users fingers against injury by tines of the arrow head during manual movement of the first weight means in a direction away from said enlarged head, and said protecting means is a thin disc slidably carried by said shaft.

11. The combination as defined in claim 1 including means for protecting the back of a users fingers against injury by tines of the arrow head during manual movement of the first weight means in a direction away from said enlarged head.

12. The combination as defined in claim 1 including means for protecting the back of a users fingers against injury by tines of the arrow head during manual movement of the first weight means in a direction away from said enlarged head, and said protecting means is a thin disc slidably carried by said shaft.

13. The combination as defined in claim 1 wherein said elongated shaft is a bolt, said enlarged head is a bolt head, and said first securing means are external bolt threads.

14. The combination as defined in claim 1 including means between said first weight means and said first securing means when said first weight means functions as a bow stabilizer for preventing sliding movement of said first weight means relative to said shaft.

15. A combined archery bow stabilizer and embedded arrow head remover comprising a generally elongated shaft having opposite end portions, an enlarged head at one of said opposite end portions, a first weight means slidably movable along said shaft between said end portions when utilized as an arrow head remover and being immovable relative to said shaft when utilized as a bow stabilizer, first means on said shaft for securing the other of said opposite end portions to an archery bow, said first weight means functions as a bow stabilizer, second means on said shaft for securing said other of said opposite to the stem of an arrow head embedded in a tree or the like, and the first weight means can be manually impacted against said enlarged head to create impact forces transferred through said shaft to an arrow head to thus facilitate the removal thereof from a tree or the like, and a second weight means carried by said shaft only when said combination is used as a bow stabilizer and being removed and unused when said first weight means is used to create impact forces during arrow head removal.

16. A combined archery bow stabilizer and embedded arrow head remover comprising a generally elongated shaft having opposite end portions, an enlarged head at one of said opposite end portions, a first weight means slidably movable along said shaft between said end portions when utilized as an arrow head remover and being immovable relative to said shaft when utilized as a bow stabilizer, first means on said shaft for securing the other of said opposite end portions to an archery bow, said first weight means functions as a bow stabilizer, second means on said shaft for securing said others of said opposite to the stem of an arrow head embedded in a tree or the like, the first weight means can be manually impacted against said enlarged head to create impact forces transferred through said shaft to an arrow head to thus facilitate the removal thereof from a tree or the like, said first and second securing means are respective external and internal threads, and a second weight means carried by said shaft only when a combination of said first and second weight means is used as a bow stabilizer, and said second weight means being removed and unused when said first weight means is used to create impact forces during arrow head removal.

17. A combined archery bow stabilizer and embedded arrow head remover comprising a generally elongated shaft having opposite end portions, an enlarged head at one of said opposite end portions, a first weight means slidably movable along said shaft between said opposite end portions when utilized as an arrow head remover and being immovable relative to said shaft when utilized as a bow stabilizer, first means on said shaft for securing the other of said opposite end portions to an archery bow, said first weight means functions as a bow stabilizer, second means on said shaft for securing the other of said opposite end portions to the stem of an arrow head embedded in a tree or the like, the first weight means can be manually impacted against said enlarged head to create impact forces transferred through said shaft to an arrow head to thus facilitate the removal thereof from a tree or the like, said first and second securing means are respective external and internal threads, means for protecting the back of a user's fingers against injury by tines of the arrow head during manual movement of the first weight means in a direction away from said enlarged head, and a second weight means carried by said shaft only when a combination of said first and second weight means is used as a bow stabilizer and said second weight means being removed and unused when said first weight means is used to create impact forces during arrow head removal.

18. The combination as defined in claim 17 wherein said protecting means is sandwiched between said first and second weight means.

* * * * *